US010196193B2

(12) United States Patent
Ross-Zolkiewicz

(10) Patent No.: US 10,196,193 B2
(45) Date of Patent: Feb. 5, 2019

(54) INSULATION ELEMENT COMPRISING A HANDLE LABEL AND HANDLE LABEL FOR THIS INSULATION ELEMENT

(71) Applicant: SAINT-GOBAIN ISOVER, Courbevoie (FR)

(72) Inventor: Jerzy Ross-Zolkiewicz, Rachowice (PL)

(73) Assignee: SAINT-GOBAIN ISOVER, Courbevoie (FR)

( * ) Notice: Subject to any disclaimer, the term of this patent is extended or adjusted under 35 U.S.C. 154(b) by 0 days.

(21) Appl. No.: 15/555,224

(22) PCT Filed: Feb. 25, 2016

(86) PCT No.: PCT/FR2016/050438
§ 371 (c)(1),
(2) Date: Sep. 1, 2017

(87) PCT Pub. No.: WO2016/139407
PCT Pub. Date: Sep. 9, 2016

(65) Prior Publication Data

US 2018/0050853 A1 Feb. 22, 2018

(30) Foreign Application Priority Data

Mar. 2, 2015 (FR) ..... 15 51735

(51) Int. Cl.
*B65D 75/56* (2006.01)
*B65D 85/08* (2006.01)

(52) U.S. Cl.
CPC ..... *B65D 75/56* (2013.01); *B65D 85/08* (2013.01)

(58) Field of Classification Search
CPC ..... B65D 33/06; B65D 33/08; B65D 75/56; B65D 85/08

(Continued)

(56) References Cited

U.S. PATENT DOCUMENTS 3,208,492 A * 9/1965 Braithwaite ..... B65D 33/065 383/20
4,867,575 A * 9/1989 Wood ..... B65D 33/06 383/10

(Continued)

FOREIGN PATENT DOCUMENTS

DE 299 13 624 U1 12/1999
WO WO 01/10737 A1 2/2001
WO WO 2012/072600 A2 6/2012

OTHER PUBLICATIONS

International Preliminary Report on Patentability and the Written Opinion of the International Searching Authority as issued in International Patent Application No. PCT/FR2016/050438, dated Sep. 5, 2017.

(Continued)

*Primary Examiner* — Chun Cheung
(74) *Attorney, Agent, or Firm* — Pillsbury Winthrop Shaw Pittman LLP

(57) ABSTRACT

An insulation element includes a roll, or a panel, of insulating material, such as glass wool or rock wool, the insulation element further including at least one label including, on the one hand, an outer film having a top printed face and, on the other hand, a layer of adhesive material situated under the outer film, the label being applied against a surface of the insulation element and adhering to this surface by the layer of adhesive material, the label having a handle to manually grasp the insulation element, wherein the label includes at least two longitudinal incisions which both pass through the outer film and the layer of adhesive material over all of their respective thicknesses and a portion of support film which is situated on the one hand at least partly between the two longitudinal incisions and on the other hand under the layer of adhesive material.

17 Claims, 3 Drawing Sheets

(58) Field of Classification Search
USPC ..... 206/389, 545, 321; 220/759, 768; 383/6, 383/12, 20, 17, 22, 26; 40/661.12
See application file for complete search history.

(56) References Cited

U.S. PATENT DOCUMENTS

| | | | | | |
|---|---|---|---|---|---|
| 5,135,125 | A * | 8/1992 | Andel | A61M 5/1417 | 215/12.1 |
| 5,467,915 | A * | 11/1995 | Mattson | A45C 13/26 | 215/396 |
| 5,490,658 | A * | 2/1996 | Coward | A61M 5/1417 | 215/399 |
| 5,829,788 | A * | 11/1998 | Jackson | B65D 23/005 | 283/81 |
| 6,110,553 | A * | 8/2000 | Grosskopf | B32B 27/08 | 428/40.1 |
| 6,272,780 | B1 * | 8/2001 | Satamian | B31D 1/0018 | 215/399 |
| 6,457,747 | B1 * | 10/2002 | Treleaven | B65D 23/005 | 215/399 |
| 7,185,762 | B2 * | 3/2007 | Ferris | B65D 33/10 | 206/525 |
| 2004/0094980 | A1 * | 5/2004 | Armbrust | B65D 71/0088 | 294/74 |
| 2011/0280501 | A1 | 11/2011 | Brauer et al. | | |
| 2012/0145733 | A1 | 6/2012 | Heilman et al. | | |

OTHER PUBLICATIONS

International Search Report as issued in International Patent Application No. PCT/FR2016/050438, dated May 20, 2016.

* cited by examiner

INSULATION ELEMENT COMPRISING A HANDLE LABEL AND HANDLE LABEL FOR THIS INSULATION ELEMENT

CROSS-REFERENCE TO RELATED APPLICATIONS

This application is the U.S. National Stage of PCT/FR2016/050438, filed Feb. 25, 2016, which in turn claims priority to French patent application number 1551735 filed Mar. 2, 2015. The content of these applications are incorporated herein by reference in their entireties.

The present invention relates to the field of insulation elements for buildings, which comprise a handle in order to facilitate the holding and handling thereof before their application as such as insulation element, even during their application as such as insulation element.

The present invention relates more particularly to an insulation element, possibly packaged and/or compressed, said element comprising at least one roll of insulating material, or at least one panel of insulating material, the insulating material being able, for example, to be glass wool or rock wool, said roll or panel being notably surrounded at least partially by a package of plastic material or of cardboard, said insulation element further comprising at least one label comprising an outer film and a layer of adhesive material which is situated directly or indirectly under said outer film and under all of the surface of said outer film, said label being applied against a surface which can be that of a package or of the roll or panel itself, of said insulation element and adhering to this surface by said layer of adhesive material, said label having a handle making it possible to manually grasp said insulation element and the layer of adhesive material being present where the handle is.

One characteristic of an insulation element before its use as such as insulation element of a building is that it is relatively lightweight (from 5 to 25 kg) such that it can be grasped manually, while being relatively bulky, with an overall length of the order of 1.0 or 1.2 m and an overall width of the order of half the length or an overall length and width each of the order of 0.5 or 0.6 m; an insulation element can therefore, by its nature, be grasped manually, bodily, but is not easy to handle; more importantly, it is difficult for a person to grasp and handle a number of insulation elements at once, which can however be very useful for saving time in particular on construction, or renovation sites.

The problem of the intrinsically clumsy grasping and handling of the building insulation elements is known to those skilled in the art.

The patent application numbers WO 01/10737, DE 29913624, or even WO 2012/072600 propose solutions to this problem.

The international patent application number WO 2012/072600 proposes in particular a label solution comprising at least one outer film under which are arranged, in this order, at least one layer of adhesive material and one removable support which is intended to be removed upon the application of the label to the surface of the packaging of the insulation element.

This label can comprise two longitudinal incisions which both pass through said outer film over all of its thickness, and only this outer film.

To be able to grasp the label by a portion of the outer film which is situated between the two incisions after the label has been glued to the packaging by the layer of adhesive material, and therefore to be able to manually grasp the insulation element by this portion which is called "handle portion", it is proposed in this document to cover the layer of adhesive material which is situated under this portion of handle with a layer of lacquer which will "kill" (that is the word used in this document) the layer of adhesive material. The description specifies that the total thickness in the handle portion is: the thickness of the outer film plus the thickness of the layer of adhesive material plus the thickness of the lacquer plus the thickness of the ink (the ink being assumed to be deposited opposite, on the outer film); this total thickness is approximately 170 μm.

No example of lacquer is cited in this document. It is assumed that the lacquer is deposited under the handle portion during production of the label because it is explained that the total thickness of the label with the removable support film which has to be removed for the label to be glued to the insulation element is less than a value (250 μm) which is greater than the sum of the total thickness (170 μm) and of the support film (60 μm).

The application of this lacquer under the handle portion is difficult: the presence of this lacquer and its localized application, only under the handle portion, each generate an additional cost for the production of the label, and therefore for the production of the insulation element.

The present invention proposes a solution to make it possible to manually grasp one or more insulation elements of the abovementioned type, in a reliable and practical manner, with a label which is simple to produce, inexpensive, simple to attach to said insulation element and which also has a reinforced handle.

The present invention proposes that when the label is removed from its support film to be affixed and glued against the packaging of the insulation element or against the insulation element itself, a part of this support film remains under the layer of adhesive material so that, in this portion where the support film remains, a handle is formed by the succession at least, in this order, of the outer film, of the layer of adhesive material and of the portion of support film.

This portion of support film is thus situated in the lower part of the handle and forms part of the handle; the handle therefore comprises at least, from the outside toward the roll or the panel, in this order: the outer film, the layer of adhesive material, then the portion of support film.

When the handle is grasped manually, a space is then automatically formed between the portion of support film and the roll or the panel, or the packaging if it has any, onto which the label is glued, since the portion of support film does not adhere to the roll or to the panel, or to the packaging if it has any.

The label according to the invention is thus a handle label which has two states:

- a covering state in which the label is against the roll or the panel, or its packaging if it has any, with the portion of support film completely against the roll or the panel, or its packaging if it has any and without adhering thereto; in this state the label protrudes from the surface of the insulation element only by the height of its thickness;
- a raised state: which is achieved by sliding at least one finger through one of the longitudinal incisions and between, on the one hand, the portion of support film and, on the other hand, the roll or the panel, or its packaging if it has any; in this state, the handle protrudes from the surface of the insulation element.

For a portion of the support film of the complete label to remain under the layer of adhesive material in the part of the label corresponding to the handle, it is proposed that said two longitudinal incisions also pass through the thickness of this support film and that two transverse incisions be produced over the thickness of this support film but without passing through said outer film, in order to facilitate the transverse cutting of the portion of support film and make it possible to form a portion of support film which is completely within the periphery of the label.

The present invention thus relates, in its widest accepted terms, to an insulation element according to claim 1. This insulation element comprises at least one roll, or at least one panel, of insulating material, such as glass wool or rock wool, said insulation element further comprising at least one label comprising, on the one hand, an outer film having a top printed face and, on the other hand, a layer of adhesive material situated under said outer film, said label being applied against a surface of said insulation element and adhering to this surface by said layer of adhesive material, said label having a handle making it possible to manually grasp said insulation element.

This insulation element is noteworthy in that said label comprises at least two longitudinal incisions which both pass through said outer film and said layer of adhesive material over all of their respective thicknesses and a portion of support film which is situated on the one hand at least partly between said two longitudinal incisions and on the other hand under said layer of adhesive material.

Said portion of support film is situated on the one hand at least partly between said two longitudinal incisions when the label is considered widthwise and this portion of support film is situated on the other hand under said layer of adhesive material when the label is considered thickness-wise.

Said portion of support film produces a bottom reinforcement for said handle.

Said insulation element provided with the label can be in a compressed state; it can moreover be packaged: said roll or panel can be surrounded at least partially by a packaging of plastic material or of cardboard or a number of rolls or panels can be surrounded at least partially, together, by a packaging of plastic material or of cardboard.

Said layer of adhesive material is situated directly or indirectly under said outer film: it is possible for one (or more) layers to be present between said outer film and said layer of adhesive material.

The outer film can be of polypropylene. The layer of adhesive material can be a layer of acrylic glue.

In a variant, said label comprises, thickness-wise, at least said outer film under which are arranged, in this order, an intermediate layer of adhesive material, a layer of fabric and said layer of adhesive material, in order to reinforce said label and its handle. This additional reinforcement increases the thickness of the label, but the layers can be chosen to be thin in order for this increase to be reasonable (+150 μm for example). The intermediate layer of adhesive material can also be a layer of acrylic glue. The layer of fabric can be a weave or a mat using acetate threads.

This layer of adhesive material is present under all of the surface of said outer film and thus, this layer of adhesive material is present where the handle is.

Said handle is not glued (does not adhere) to said surface of said insulation element by said layer of adhesive material by virtue of the presence of said portion of support film.

Said surface onto which said label is glued can be a surface of a packaging or a surface of the roll or of the panel itself.

Said portion of support film preferably has two longitudinal edges each formed respectively by said longitudinal incisions and two transverse edges, all of these edges forming a complete periphery of portion of support film, said portion of support film being completely within the periphery of said label; no edge of said portion of support film reaches the periphery of the label.

Said portion of support film is preferably a part of a support film which is present under said layer of adhesive material before the application of said label against said surface. Thus, no layer of lacquer is present between, on the one hand, the layer of adhesive material and, on the other hand, the surface of the roll or of the panel, or of the packaging if it has any.

Said portion of support film is, preferably, situated only partly between said two longitudinal incisions, with each longitudinal incision longer than the longitudinal edge of said portion of support film which is formed by this incision, respectively.

At least one of the longitudinal incisions and preferably both longitudinal incisions is or are, preferably, incurved toward the center of said label, with a radius of curvature preferably lying between 5 and 25 cm, in order to facilitate the gripping of the handle.

At least one transverse edge, and preferably both transverse edges, of said portion of support film is or are, preferably, incurved opposite to the center of said label, with a radius of curvature preferably lying between 2 and 22 cm.

The widest width of said handle is, preferably, less than, and notably between, 0.2 and 0.9 times the widest width between a longitudinal edge of said label and an adjacent longitudinal edge of said portion of support film.

The longest length of said handle is less than the rest of the length of the label.

In a variant, said longitudinal incisions are in contact with the periphery of said label at each of their ends.

The present invention relates also to a label for an insulation element according to the invention, said label comprising at least one outer film under which are arranged, in this order, at least one layer of adhesive material and one removable support film; said label comprises at least two longitudinal incisions which both pass through said outer film, said layer of adhesive material and said removable support film over all of their respective thicknesses and at least two transverse incisions which both pass through said removable support over all of its thickness without passing through said outer film.

It may be useful to specify that the incisions also pass through said layer of adhesive material.

The two transverse incisions coincide with the transverse edges of said portion of support film which is formed in the support film by said longitudinal incisions and said transverse incisions.

Advantageously, the present invention thus makes it possible to propose a label for an insulation element which makes it possible to display information on its outer film and which makes it possible to grasp the insulation element using a handle, this label being partly glued against a surface of this insulation element by virtue of a layer of adhesive material, but this label not being glued to this surface under the handle because of the presence under the handle of this label of a portion of the support film, this portion preferably being a part of the support film on which the label was resting before the application and gluing thereof onto the surface of the insulation element.

Advantageously, the present invention thus makes it possible, very simply and with a very low extra cost compared to a label without handle, to produce a label with handle that is very practical, very reliable and very robust.

Advantageously, the handle is very practical because its use is instinctive: it is sufficient to slide fingers or a tool between the surface of the insulation element and the handle to grasp it.

The present invention will be better understood on reading the following detailed description of two nonlimiting exemplary embodiments and the attached figures.

It is specified that in these figures the elements in the background are not always represented and that, in FIGS. 3 to 6, the proportions between the various elements represented are observed, in order to facilitate the reading thereof.

Figure 1:
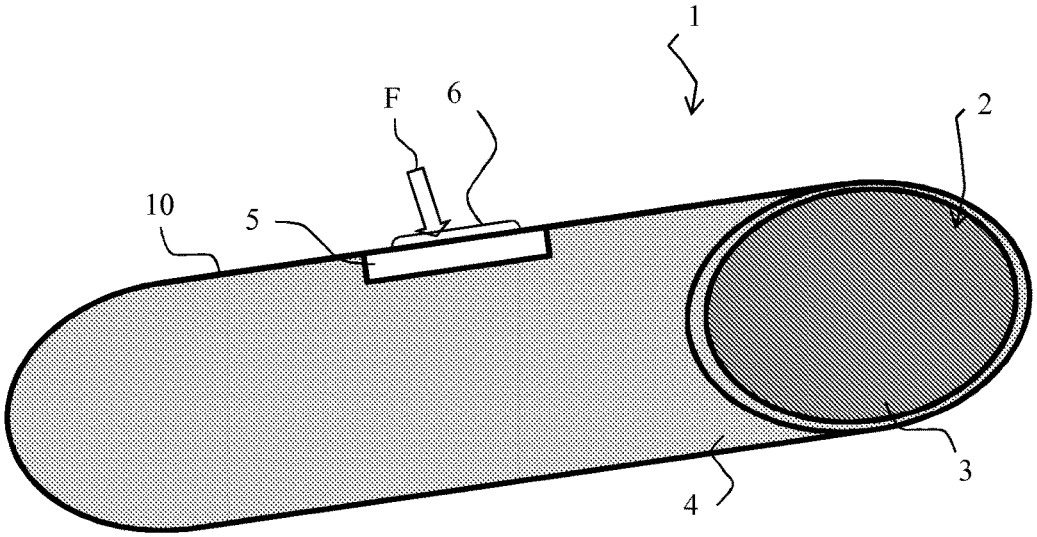
FIG. 1 illustrates a perspective view of an insulation element according to the invention comprising a roll of insulating material and a handle label according to the invention.
Figure 2:
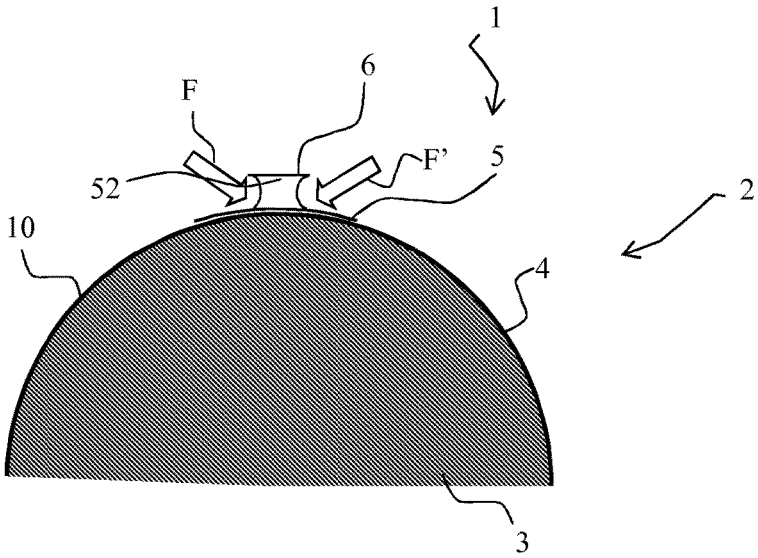
FIG. 2 illustrates a partial side view of the insulation element of FIG. 1 with the label separated from the surface of this insulation element to facilitate the understanding thereof.

The present invention relates to a means for facilitating the holding and handling of an insulation element 1, as illustrated in FIGS. 1 and 2.

In these figures, the insulation element 1 comprises a roll 2 of insulating material 3, of glass wool or of rock wool.

This insulating material may be compressed in the insulation element and the roll may be surrounded at least partially by a packaging 4 of plastic material or of cardboard which protects the insulating material and maintains the compressed state if necessary.

The insulation element could comprise a panel or could comprise a number of rolls or a or a number of panels; in the case where there are a number of panels or rolls, the packaging then at least partially surrounds all these panels or rolls.

Here, it concerns an insulation element intended to be applied against or in a building structure in order to participate in the thermal and/or sound insulation of this building.

The present invention relates to such an insulation element from the end of its production to this application.

The insulation element 1 further comprises at least one label 5 comprising, on the one hand, an outer film 50 having a top printed face and, on the other hand, a layer of adhesive material which is situated directly or indirectly (in the case where one or more other layers are interposed between the outer film and the layer of adhesive material) under the outer film 50.

The layer of adhesive material is not referenced in these diagrams because it is situated under all of the surface of the outer film 50.

The label 5 is applied against a surface 10 of the insulation element 1, which is a surface of the packaging or is a surface of the roll or of the panel itself if there is no packaging. The label 5 adheres to this surface 10 by virtue of the layer of adhesive material.

The label 5 has a handle 6 which makes it possible to manually grasp the insulation element 1. The layer of adhesive material is present where the handle is.

When the label according to the invention is applied directly onto the insulation element, it also makes it possible to favor the handling thereof during its application against or in a building structure. If this insulation element is then hidden from sight inside the building or from sight outside the building by a facing element, this label can remain on the insulation element once it is applied against or in the building structure.

The insulation element is longer than it is wide and the label 5, which here has the general form of a rectangle, is positioned with its length oriented in the same direction as the length of the insulation element.

Figure 3:
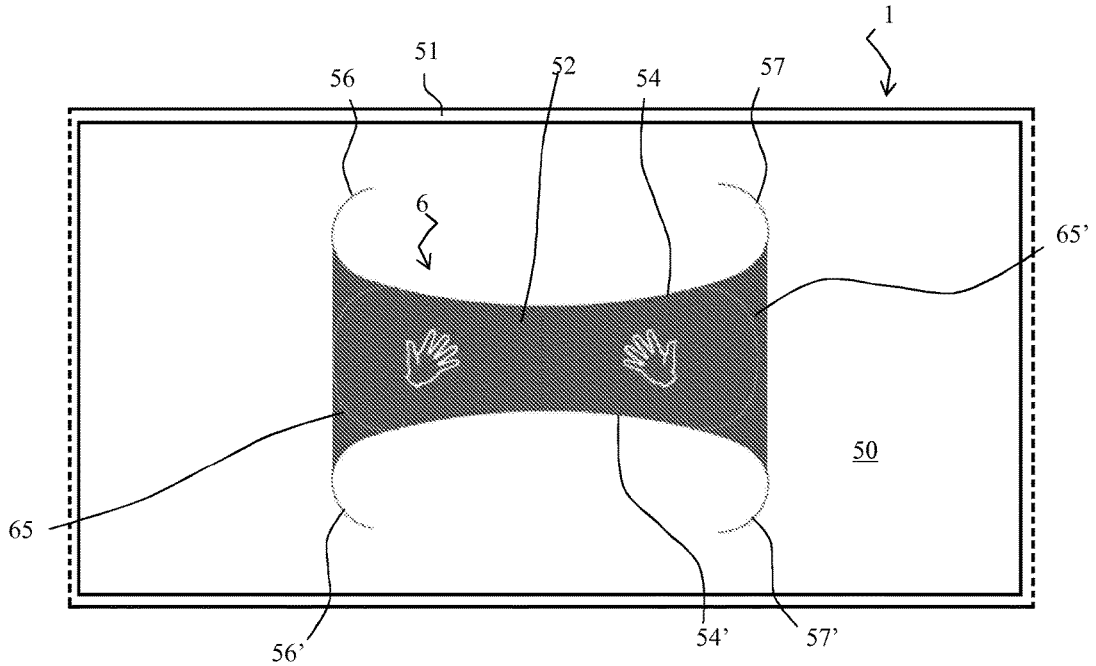
FIG. 3 illustrates a plan view of a label according to the invention on its support film.
Figure 4:
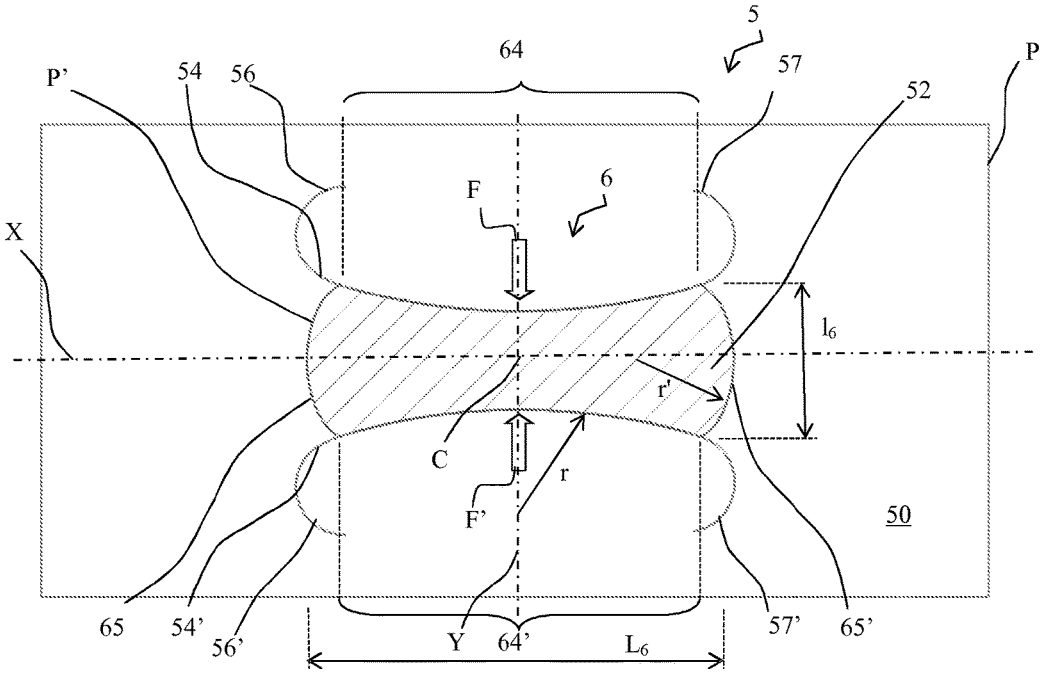
FIG. 4 illustrates the label of FIG. 3 without its support film.
Figure 5:
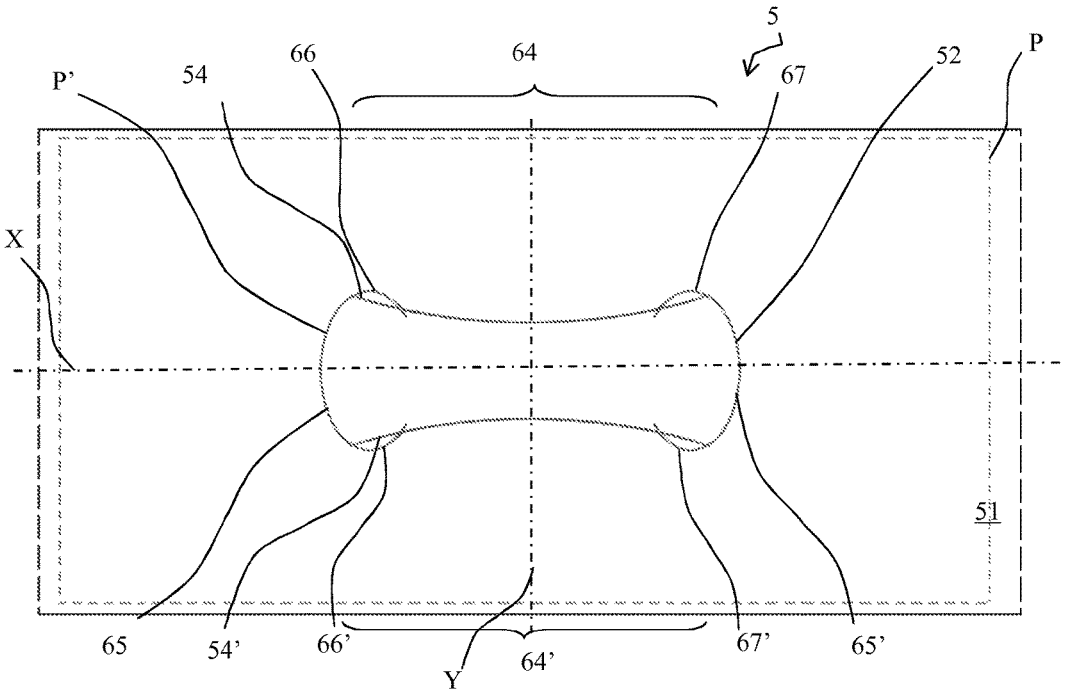
FIG. 5 illustrates the support film of FIG. 3 without the label.

As can be seen in FIGS. 3 to 5, linked to a first exemplary embodiment of the invention, the label 5 comprises at least two longitudinal incisions 54, 54' which both pass through the outer film 50 and the layer of adhesive material over all of their respective thicknesses and a portion of support film 52 which is situated:

- on the one hand, when considering the label 5 widthwise, at least partly between the two longitudinal incisions 54, 54' and
- on the other hand, when considering the label 5 thicknesswise, under the layer of adhesive material, and more specifically under all of the layer of adhesive material of the handle 6.

The portion of support film 52 which is thus situated in the bottom part of the handle 6 (when it is considered that the outer film 50 is in the top part) has two longitudinal edges 64, 64' which are each formed respectively by a longitudinal incision 54, 54'.

The portion of support film 52 also has two transverse edges 65, 65'. All of these edges form a complete periphery P' of portion of support film 52.

The edges of the portion of support film 52 thus have, in the broadest sense a parallelogram form; the edges of this parallelogram can be straight or curved; they are parallel two-by-two or symmetrical two-by-two in relation to a central longitudinal axis and/or in relation to a central transverse axis. This parallelogram can be a rectangle, elongated preferably along the length of the label.

As can be seen in FIG. 3, the portion of support film 52 is completely within the periphery P of the label 5; no edge of the portion of support film reaches the periphery of the label.

FIG. 3 shows the label 5 before it is applied and glued against the surface 10, that is to say that it shows the label 5 which is still on a support film 51, wider and longer than itself, which has been used for its production. This support film is the film which is directly in contact with the layer of adhesive material upon the production of the label and which protects this layer of adhesive material until the label is glued: it is the film that has to be removed in order to glue the label.

The portion of support film 52 is a part/an extract of the support film 51 which is present under all of the layer of adhesive material before the label 5 is applied against the surface 10. Thus, when the support film 51 is removed to be able to glue the label, the support film 51 is not all removed but only partly, in order for the portion of support film 52 to remain in the bottom part of the handle 6.

This separation of the portion of support film 52, which is the cross-hatched portion in FIG. 4, from the support film 51 occurs automatically when a finger, even a tool, is slid under the handle 6, between the portion of support film 52 and the surface 10 onto which the rest of the label is glued. This operation is illustrated by the arrow F or the arrow F' in FIGS. 2 and 4, depending on whether the finger or the tool is slid from the left or from the right when the label is considered lengthwise.

The expression "at least partly between the two longitudinal incisions 54, 54'" above describes the fact that each of these longitudinal incisions can be longer, respectively, than the longitudinal edge 64, 64' which is formed by this incision.

Here, the label has a central longitudinal axis X, which is a longitudinal axis of symmetry and a central transverse axis Y which is a transverse axis of symmetry. The longitudinal axis of symmetry makes it possible to not impose any lengthwise direction of the label when it is glued and each of these two axes of symmetry allows for a balanced distribution, on each side of this axis, of the stresses caused by the holding of the handle. These two axes are secant to the point C which is the center of the label. The two longitudinal incisions 54, 54' are symmetrical to one another in relation to the central longitudinal axis X and the two transverse edges 65, 65' are symmetrical to one another in relation to the central transverse axis Y.

As can be seen in FIG. 4, at least one of the longitudinal incisions 54, 54' and preferably both longitudinal incisions 54, 54' are incurved toward the center C of the label 5 according to a radius of curvature r, in order to facilitate the holding of the handle. This radius of curvature lies preferably between 5 and 25 cm.

As can be seen also in this FIG. 4, at least one transverse edge 65, 65', and preferably both transverse edges 65, 65', of the portion of support film 52 are incurved opposite to the center C of the label 5 according to a radius of curvature r' in order to improve the securing of the label against the surface 10 in this zone. This radius of curvature r' is preferably between 2 and 22 cm.

Preferably, the radius of curvature r of the incurvation of the longitudinal incisions/longitudinal edges of the portion of support film is greater than the radius of curvature r' of the incurvation of the transverse edges of the portion of support film, in order to facilitate the detachment of the portion of support film 52 from the rest of support film 51 when the label 5 is applied against the surface 10.

In order for the portion of the label that is not handle 6, widthwise, to be wide enough to adhere correctly, the widest width $l_6$ of the handle is less than the widest width (that is to say, here, along the axis Y) between a longitudinal edge of the label 5 and an adjacent longitudinal edge 64, 64' of the portion of support film 52.

This width $l_6$ of the handle is preferably between 0.2 and 0.9 times the widest width between a longitudinal edge of the label 5 and an adjacent longitudinal edge 64, 64' of the portion of support film 52. This width $l_6$ can be, for example, 80 mm for an overall width of the label 5 of 150 mm.

In order for the portion of the label that is not handle 6, lengthwise, to be long enough to adhere correctly, the longest length $L_6$ of the handle (that is to say, here, along the axis X) is less than the rest of the length of the label, that is to say that the length $L_6$ is less than ⅔ of the length of the label. This length $L_6$ can for example be 130 mm for an overall length of the label 5 of 300 mm.

The longitudinal incisions 54, 54' which form the longitudinal edges of the portion of support film 52 continue beyond the longitudinal end of these edges by arcs: the longitudinal incision 54 is continued at each of its ends by an arc which is referenced 56, 57 and the longitudinal incision 54' is continued at each of its ends by an arc which is referenced 56', 57'. These four arcs, which all turn back toward the central transverse axis Y, facilitate the lifting of the handle 6 and the separation of the part of outer film 50 which forms the handle from the rest of the outer film which is glued against the surface 10, without breaking this outer film.

FIG. 5 illustrates the cuts produced over the thickness of the support film 51 in the production of the label. In this figure, the presence of the label is shown only by its periphery P, by dotted lines.

This support film can in particular be in the form of a tape (that is why, in FIG. 5 and in FIG. 3, the edges of the support film on the left and on the right are shown by dotted lines).

The longitudinal edges 64, 64' and transverse edges 65, 65' which form the outline of the portion of support film 52 are visible.

The two ends of each incision which forms a transverse edge 65, 65' both pass through the two longitudinal ends of two longitudinal edges.

The succession of the longitudinal edge 64, then of the transverse edge 65, then of the longitudinal edge 64', then of the transverse edge 65' forms, in the support film 51, a closed outline for the portion of support film 52, marked by the periphery P'.

This portion of support film 52, which remains on the bottom face of the handle 6 when the handle is grasped, not only makes it possible to pass fingers or a tool under the handle 6 without these fingers or this tool sticking to the layer of adhesive material of the handle, but also makes it possible to reinforce the handle by distributing the forces imparted by the fingers or the tool over a greater surface area than if these fingers or this tool were in contact with the layer of adhesive material of the handle; this reinforcement is essential for the insulation element which is a very specific object with respect to its weight relative to its bulk and with respect to the handling operations which are applied to it before and during its application in or against a building structure.

In FIG. 5, each of the incisions in the support film which forms a transverse edge is continued by an arc which is referenced 66, 66' for the incision which forms the transverse edge 65 and which is referenced 67, 67' for the incision which forms the transverse edge 65'. These four arcs, all turned back toward the central longitudinal axis X, facilitate the separation of the portion of support film 52 upon the removal of the rest of the support film 51 for the label 5 to be glued against the surface 10.

Figure 6:
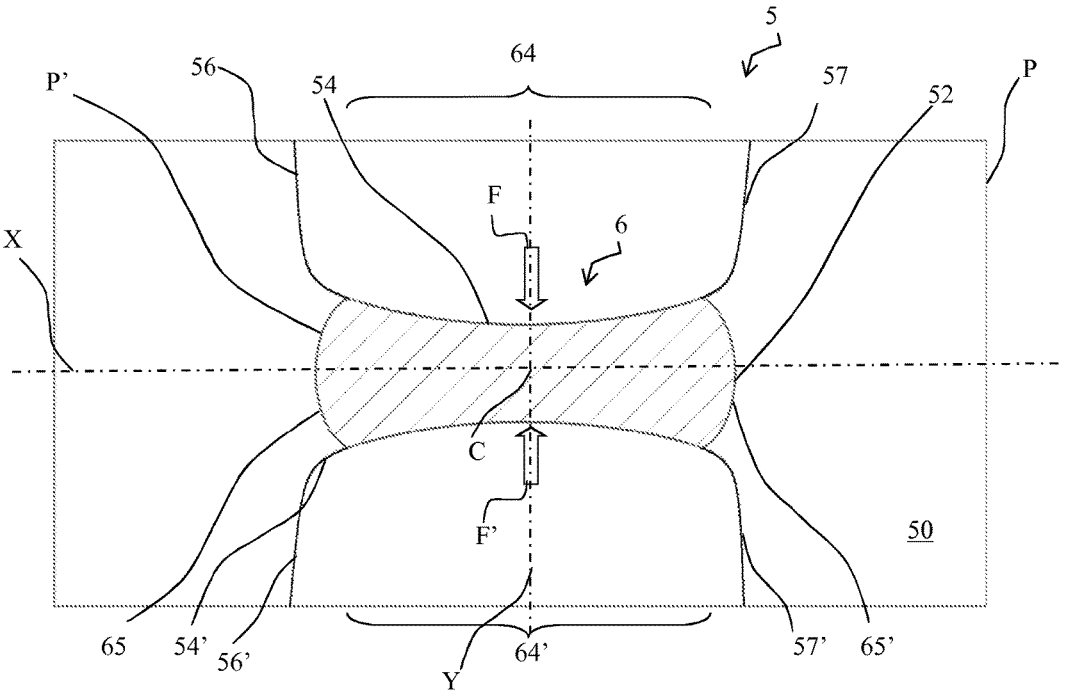
FIG. 6 illustrates a variant embodiment of a label according to the invention.

FIG. 6 illustrates a second exemplary embodiment of the invention. The label 5 comprises, as for the first example, at least two longitudinal incisions 54, 54' which both pass through the outer film 50 and the layer of adhesive material over all of their respective thicknesses and a portion of support film 52, which is cross-hatched in this FIG. 6 and which is situated:

- on the one hand, when the label 5 is considered widthwise, at least partly between the two longitudinal incisions 54, 54' and
- on the other hand, when the label 5 is considered thickness-wise, under the layer of adhesive material, and under all of said layer of adhesive material of the handle 6.

The only difference between this second example and the first example lies in the fact that the longitudinal incisions 54, 54' which form the longitudinal edges of the portion of support film 52 are in contact with the periphery P of said label 5 at each of their ends.

This label 5 is more appropriate to lightweight insulation elements and in particular when the label is glued directly onto a surface of the insulation element; the fact that the longitudinal incisions 54, 54' extend as far as the longitudinal edges of the label favors the separation of the label into a number of pieces and thus facilitates the removal of the label when there is a desire to remove it.

The present invention is described in the above by way of example. It is understood that a person skilled in the art is able to produce different variants of the invention without in any way departing from the scope of the patent as defined by the claims.

For example, a person skilled in the art may produce a number of handles in one and the same label; the label may be of large size and participate itself in the packaging of the insulation element.

The invention claimed is:

1. An insulation element comprising at least one roll, or at least one panel, of insulating material, said insulation element further comprising at least one label comprising an outer film having a top printed face and a layer of adhesive material situated under said outer film, said label being applied against a surface of said insulation element and adhering to said surface by said layer of adhesive material, said label having a handle permitting to manually grasp said insulation element, wherein said label comprises at least two longitudinal incisions which both pass through said outer film and said layer of adhesive material over all of their respective thicknesses and through a portion of removable support film that is removably attached to the label, the portion of the removable film being situated at least partly between said two longitudinal incisions and under said layer of adhesive material.

2. The insulation element as claimed in claim 1, wherein said portion of removable support film has two longitudinal edges each formed respectively by said longitudinal incisions and two transverse edges, all of the two longitudinal and two transverse edges forming a complete periphery of portion of support film, said portion of support film being completely within a periphery of said label.

3. The insulation element as claimed in claim 1, wherein said removable support film is present under said layer of adhesive material before the application of said label against said surface.

4. The insulation element as claimed in claim 1, wherein said label comprises, thickness-wise, at least said outer film under which are arranged, in this order, an intermediate layer of adhesive material, a layer of fabric and said layer of adhesive material.

5. The insulation element as claimed in claim 1, wherein said portion of removable support film is situated only partly between said two longitudinal incisions, with each longitudinal incision longer than a longitudinal edge of said portion of removable support film which is formed by said incision, respectively.

6. The insulation element as claimed in claim 1, wherein at least one of the two longitudinal incisions is incurved toward a center of said label.

7. The insulation element as claimed in claim 6, wherein both longitudinal incisions are incurved toward the center of said label.

8. The insulation element as claimed in claim 7, wherein both longitudinal incisions are incurved toward the center of said label with a radius of curvature (r) lying between 5 and 25 cm.

9. The insulation element as claimed in claim 1, wherein at least one transverse edge of said portion of removable support film is incurved opposite to a center of said label.

10. The insulation element as claimed in claim 9, wherein both transverse edges of said portion of removable support film are incurved opposite to the center of said label.

11. The insulation element as claimed in claim 10, wherein both transverse edges of said portion of support removable film are incurved opposite to the center of said label with a radius of curvature (r') lying between 2 and 22 cm.

12. The insulation element as claimed in claim 1, wherein a widest width of said handle is less than a widest width between a longitudinal edge of said label and an adjacent longitudinal edge of said portion of removable support film.

13. The insulation element as claimed in claim 12, wherein the widest width of said handle is between 0.2 and 0.9 times the widest width between the longitudinal edge of said label and the adjacent longitudinal edge of said portion of removable support film.

14. The insulation element as claimed in claim 1, wherein a longest length of said handle is less than the rest of the length of said label.

15. The insulation element as claimed in claim 1, wherein said longitudinal incisions are in contact with a periphery of said label at each of their ends.

16. The insulation element as claimed in claim 1, wherein the insulating material is glass wool or rock wool.

17. A label for an insulation element including at least one roll, or at least one panel, of insulating material, said label comprising at least one outer film under which are arranged, in this order, at least one layer of adhesive material and one removable support film, said label to be applied against a surface of said insulation element and adhering to said surface by said layer of adhesive material, said label having a handle permitting to manually grasp said insulation element, wherein said label comprises at least two longitudinal incisions which both pass through said outer film, said layer of adhesive material and said removable support film over all of their respective thicknesses and at least two transverse incisions which both pass through said removable support film over all of its thickness without passing through said outer film.

* * * * *